US005454410A

United States Patent [19]

Edfors

[11] Patent Number: 5,454,410

[45] Date of Patent: Oct. 3, 1995

[54] APPARATUS FOR ROUGH-SPLITTING PLANKS

[76] Inventor: John E. Edfors, 142 Pierce Rd., Townsend, Mass. 01469

[21] Appl. No.: 213,664

[22] Filed: Mar. 15, 1994

[51] Int. Cl.[6] ..... B27L 7/00

[52] U.S. Cl. ..... 144/193 C; 30/176; 30/186; 144/193 R

[58] Field of Search ..... 144/193 R, 193 C, 144/366; 30/173, 175, 176, 186, 191, 192, 193, 194

[56] References Cited

U.S. PATENT DOCUMENTS

| | | | |
|---|---|---|---|
| 681,756 | 9/1901 | Topuet | 30/176 |
| 710,181 | 9/1902 | Carolus | 30/176 |
| 1,971,611 | 8/1934 | Hill | 30/186 |

*Primary Examiner*—W. Donald Bray

*Attorney, Agent, or Firm*—Gerald J. Cechony

[57] ABSTRACT

A mechanical hand tool converts random-sized boards or planks into small, uniformly sized pieces suitable for use as kindling wood for stoves, fireplaces, and campfires. The device as a whole works on the principle of pincers or nippers, comprising two handles connected by means of a series of pivots and levers to jaws carrying opposing splitter blades. The mechanical advantage of the tool is increased significantly by the compounding action of the multiple pivots such that the physical effort involved in applying the tool is minimized. The tool is applied by holding the work, consisting of any of a broad range of predetermined sizes, edge-up between the feet of a user, who stands erect and astride the board or plank as it lies on the floor or ground. By a succession of side-to-side opening and closing actions of the tool in combination with forward and backward motions, utilizing the handles to provide leverage, small pieces can be split away and broken off from the main piece, as the operator works along its length and width, until said main piece is thus completely converted.

13 Claims, 5 Drawing Sheets

APPARATUS FOR ROUGH-SPLITTING PLANKS

FIELD OF THE INVENTION

The present invention relates to hand tools, particularly to hand tools for cutting, splitting, or shearing, and most particularly to hand tools for rough-splitting boards or planks into kindling or the like.

PRIOR ART

Presently a person who is in need of kindling wood must purchase commercially prepared materials or search for natural materials such as small twigs, branches, or limbs of trees and break them up without aid of tools or use available tools such as axes, hatchets, saws, or pruning shears to reduce them into smaller pieces suitable for kindling. There is also a large supply of man-made material often available to the average person in the form of scrap or discarded wood building materials or industrial materials such as pallets or crates. Hand methods, axes, and saws may also be applied to the task of reducing these materials (but not pruning shears as a practical matter). One might wish to apply power saws to the task, but this is seriously limited due to the high incidence of nails and other foreign materials typically found in this type of scrap material.

OBJECTS OF THE INVENTION

It is an object, therefore, of the instant invention to convert scrap lumber of various types, sizes, and conditions into pieces of uniform-sized kindling wood by the systematic and repetitive manual application of shearing and breaking actions in a prescribed manner by the user.

It is further an object of this invention to enhance the speed, efficiency, and safety of converting said scrap lumber to kindling wood.

SUMMARY OF THE INVENTION

The above objects are achieved in a preferred embodiment of the present invention which is an assembly comprising four movable parts or subassemblies connected to one another at four pivot points. There are two upper movable parts or subassemblies which function as handles. There are two lower movable parts or subassemblies that function as jaws in the pincer action of the total assembly. The upper and lower pivoting pairs of parts or subassemblies are connected to each other via compound pivots, such that the pivoting of the handles causes corresponding pivoting of the jaws. The jaws are provided with splitter blades, which will split a wooden workpiece inserted between the jaws.

BRIEF DESCRIPTION OF THE DRAWINGS

The features and advantages of the present invention will become apparent from the following detailed description of a preferred embodiment thereof, taken in conjunction with the accompanying drawings in which.

DESCRIPTION OF THE PREFERRED EMBODIMENT

A preferred embodiment of the present invention is an assembly comprising four movable parts or subassemblies connected to one another at four pivot points. There are two upper movable parts or subassemblies which function as handles. There are two lower movable parts or subassemblies that function as jaws in the pincer action of the total assembly. The upper and lower pivoting pairs of parts or subassemblies are connected to each other via two secondary pivot points, such that the pivoting of the handles causes corresponding rotation of the jaws.

The length of the handles, the relative location of the pivots (which causes a larger angular displacement of the handle pair with respect to the jaw pair), and the opening distance of the jaws relate to each other to provide an overall mechanical advantage of about 30:1 in a preferred embodiment. The splitter blades are flat plates each with a sharp edge disposed toward the center of the tool. These sharp edges are mounted perpendicularly to the jaws in such a way that they move toward each other as the jaws pivot toward each other. In the closed position the blades meet each other along their respective sharp edges. This is what enables the invention to apply a shearing or splitting action along the grain of wood for conversion to kindling. These splitter blades are detachable to enable periodic sharpening. The overall length of the handles is determined not only by the object of providing leverage but also to allow the user to operate the invention in a comfortable position. The spacing of the blades in the open position is determined by its object of splitting common planks as well as board dimension lumber. The design of the upper pivoting members contains features that limit the travel of the handles both inward and outward. There is also a locking device on the upper section, which is a safety feature, that ensures that the invention is retained in the closed position when not in use.

Figure 1:
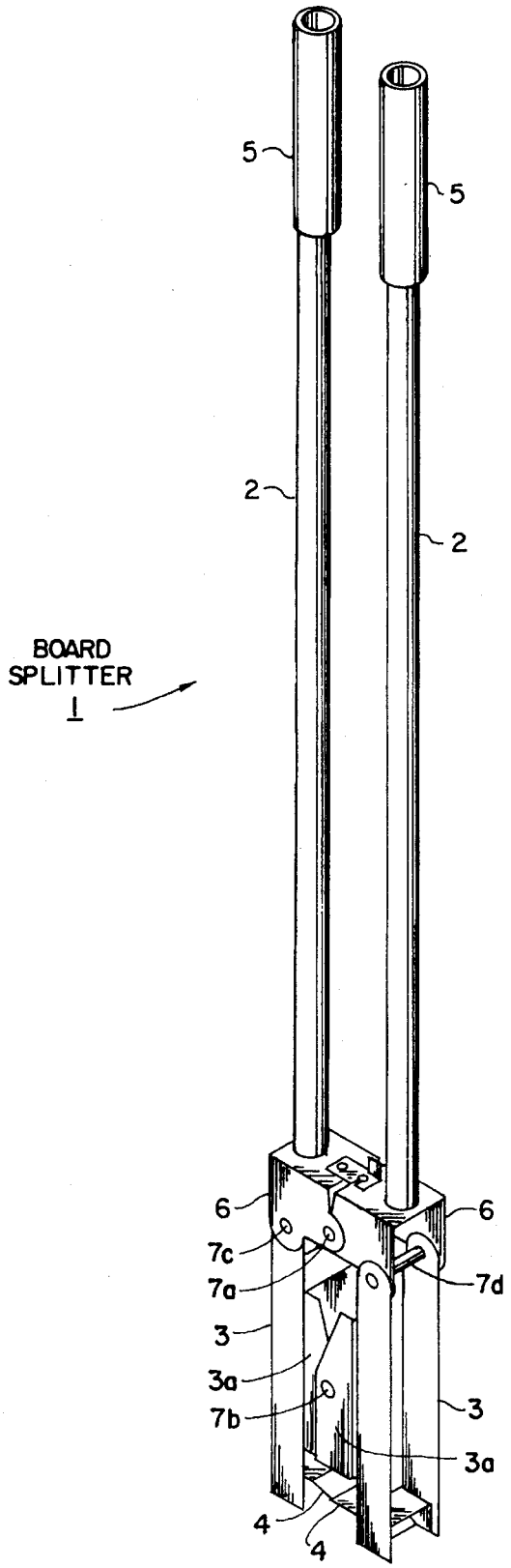
FIG. 1 is a perspective illustration of the Board Splitter assembly in its closed position, constructed in accordance with a preferred embodiment of the present invention.

FIG. 1 depicts the apparatus 1 comprising two identical handle subassemblies 2 and two identical jaws 3 each fastened to a jaw clevis 3*a*. Splitter blades 4, detachably affixed to jaws 3; grips 5, and clevises 6 permanently affixed to handle subassemblies 2; pivot pins 7*a*, 7*b*, 7*c*, and 7*d* which secure the four movable subassemblies in relationship to one another are also depicted in FIG. 1.

The handle subassemblies 2 are tubular in cross-section through most of their length. A gripping area of a soft material 5 is provided at the upper end and a clevis (U-bracket) 6 is solidly affixed at the lower end. The clevis is provided with two sets of pivot holes, each set comprising two holes being in alignment on the opposing flange surface of the U bracket. One set is disposed to one side; the other set is disposed downward, as can be seen in more detail in FIG. 3.

The two handle subassemblies 2, being identical, may be turned toward each other and their respective side-disposed holes lined up to receive one of the four pivot pins 7*a*, 7*b*, etc. The two elements thus pivoted together form the first stage of a compound pivoting action. As can be seen from FIG. 1, one clevis 6 is interleaved and overlapped with the other at pivot point 7*a*. This technique allows identical manufacture of the two subassemblies. The two downward disposed sets of pivot holes thus describe an arc a certain distance from the first pivot pin 7*a* as the handle subassemblies 2 are rotated in and out.

The opposing clevises 6 are formed in such a way that the travel inward of the handle subassemblies 2 is limited or stopped at their vertical position. This prevents the hands of the user from coming in forceful contact with each other at the top and the splitter blades 4 from coming into forceful contact with each other at the lower end. The two jaws 3 provide the pincer-like action of the tool.

The splitter blades 4 are flat plates with sharp edge disposed toward the center of the tool in a plane perpendicular to the jaws as shown in FIG. 1 in such a way that they move toward each other as the jaws pivot toward each other. In the closed position the splitter blades 4 just meet each other along their respective sharp edges. This is what enables the assembly 1 to apply a shearing or splitting action along the grain of wood for conversion to kindling.

The jaws 3 are designed in such a way that the splitter blades are displaced a certain distance vertically from the lowest possible point to provide a gauged width dimension for the final piece on a wider board or plank to be split and provide a measure of safety as to where the blades are located relative to a user's shoes. Further, the shape of the jaw clevises 3*a* at the lower pivot 7*b* and how this shape relates to both the pivot 7*b* location and splitter blade 4 location provides a stop for the inserted wood to be split which determines a maximum width dimension for the split kindling. This shape is such that the solid material of the jaw clevises 3*a* recedes from the center point as the jaws 3 rotate inward which prevents the sheared section of wood from being forced against the splitter blades 4, which would result in binding.

The jaw subassemblies 3, 3*a* are also identical to each other and provide the inwardly disposed sets of holes which receive a second pivot pin 7*b* which thus allows the jaw subassemblies 3, 3*a* to pivot open and closed with respect to one another. The same interleaving and overlapping effect may be observed in FIG. 1 for the jaw clevises 3*a* at pivot 7*b* as applied to the handle subassemblies 2 at pivot point 7*a*, for the same reason, except in this case in the alternate direction which will be explained subsequently. At the upper end of each jaw 3 is a set of upwardly disposed pivot holes that describe an arc at a certain distance from the lower or second pivot point 7*b* as the jaw subassemblies 3, 3*a* open and close. At the final assembly 1, these two sets of upwardly disposed holes are matched up and aligned with the downwardly disposed sets of holes of the handle subassemblies 2 such that the third and fourth pivot pins 7*c* and 7*d* respectively may be received. Here the interleaving and overlapping pattern is completed and allows these additional pivot surfaces to interleave and overlap one another, as can be observed in FIG. 1. Once all four pivot pins 7*a* through 7*d* are in place, the opening and closing action of the handle subassemblies 2 will cause a corresponding opening and closing action of the jaws 3.

Figure 2:
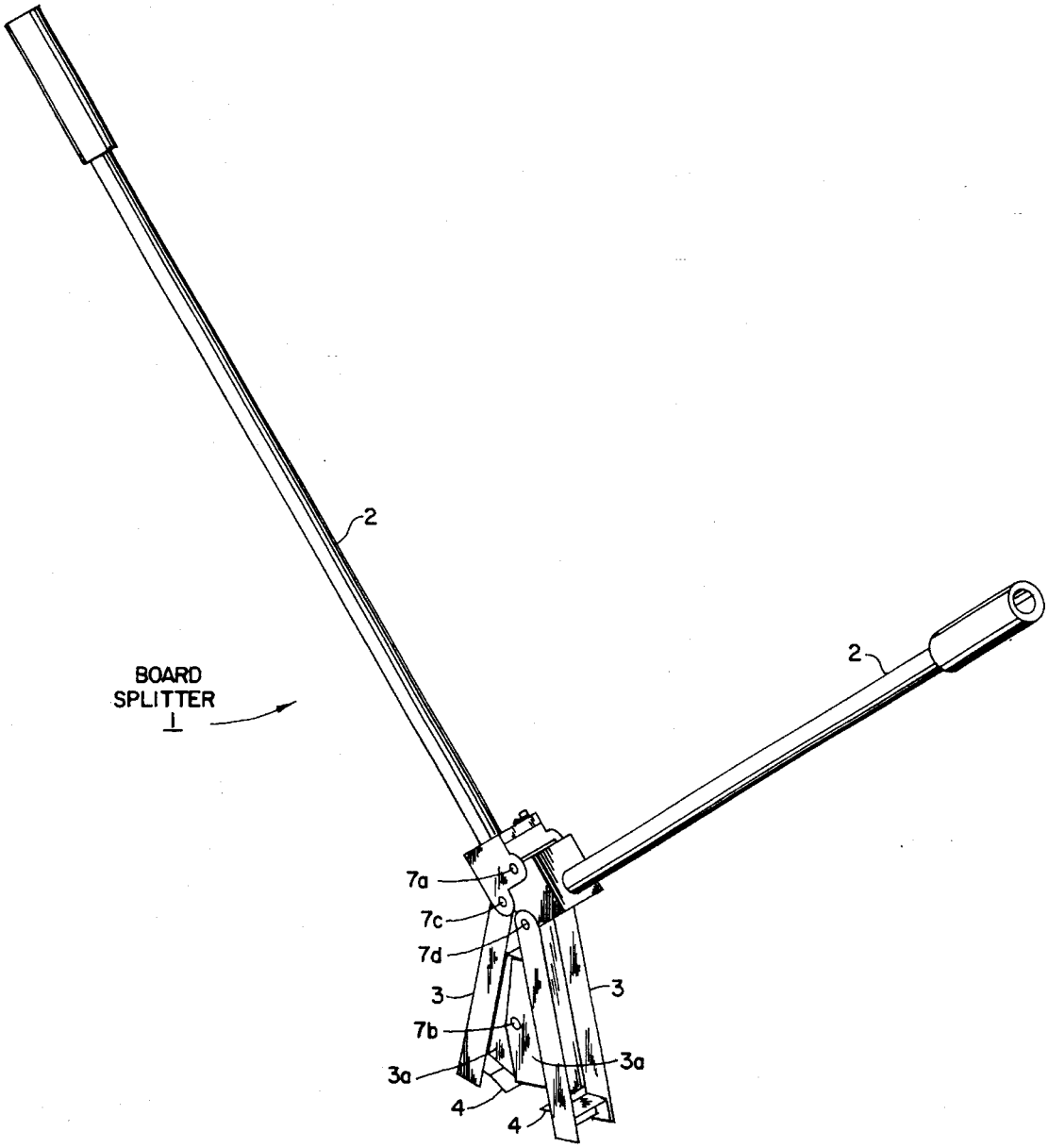
FIG. 2 is a perspective illustration of the Board Splitter assembly in its fully opened position, constructed in accordance with a preferred embodiment of the present invention.

Whereas FIG. 1 depicts the assembly 1 in its fully closed position, FIG. 2 shows assembly 1 in its fully open position. The difference in distances established from pivot 7*a* to pivots 7*c* and 7*d* in the case of the handle subassemblies 2 and from pivot 7*b* to pivots 7*c* and 7*d* in the case of jaw subassemblies 3, 3*a* causes each pair to travel through a different angular distance. The handle subassemblies 2 travel through an arc close to 45 degrees each and the jaw subassemblies 3, 3*a* about thirteen degrees. In terms of distance, the hands of the user travel about 48 inches from fully open to fully closed. The splitter blades 4, as mounted to the jaws 3, referring to FIG. 2, travel a corresponding distance of 1.6 inches from fully opened to fully closed. This provides a net mechanical advantage of about 30:1 in a preferred embodiment.

Figure 3:
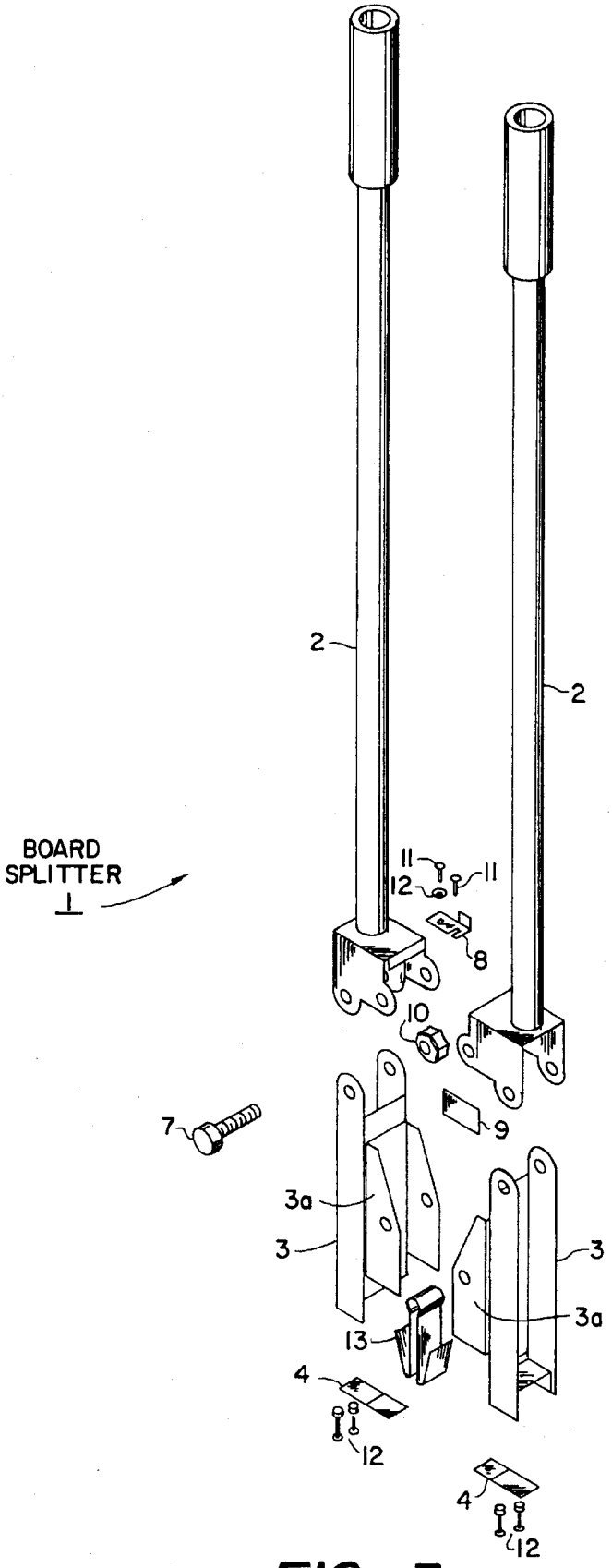
FIG. 3 is a perspective illustration of the Board Splitter assembly in exploded view, constructed in accordance with a preferred embodiment of the present invention.

FIG. 3 which is a perspective exploded view of the assembly 1. FIG. 3 depicts safety latch 8. This simple device is attached by a shoulder screw 11 to clevis 6 at the left, which mounting allows it to rotate about a vertical axis. A second shoulder screw 11 is mounted in a corresponding position on the right hand clevis 6. Safety latch 8 is provided with an open slot that hooks around the right hand shoulder screw 11 when the safety latch 8 is rotated into place once the handle subassemblies 2 are in the vertical position. An upraised tab is provided on safety latch 8 to facilitate its manipulation by the user. Further a spring washer 12 is assembled between the shoulder screw 11 and the safety latch 8 at the left to provide adequate frictional resistance to inadvertent rotation.

FIG. 3 also depicts how splitter blades 4 are detachable from jaws 3 by means of screws 12 to enable periodic sharpening.

Further, FIG. 3 depicts how pivot pin 7 is typically held in the assembly by means of retaining ring 10

Safety and user instruction decal 9 is also depicted in FIG. 3.

In addition, FIG. 3 depicts ejection spring 13, which is a device formed from a flexible material of such qualities that in the shape depicted it is compressed while material is being split but springs back toward the center when the jaws 3 are opened, keeping the split material centered between the jaws rather than being pulled to one side by friction with a retreating splitter blade, thus enabling the split material to fall out without being lodged above the splitter blades 4.

Figure 5B:
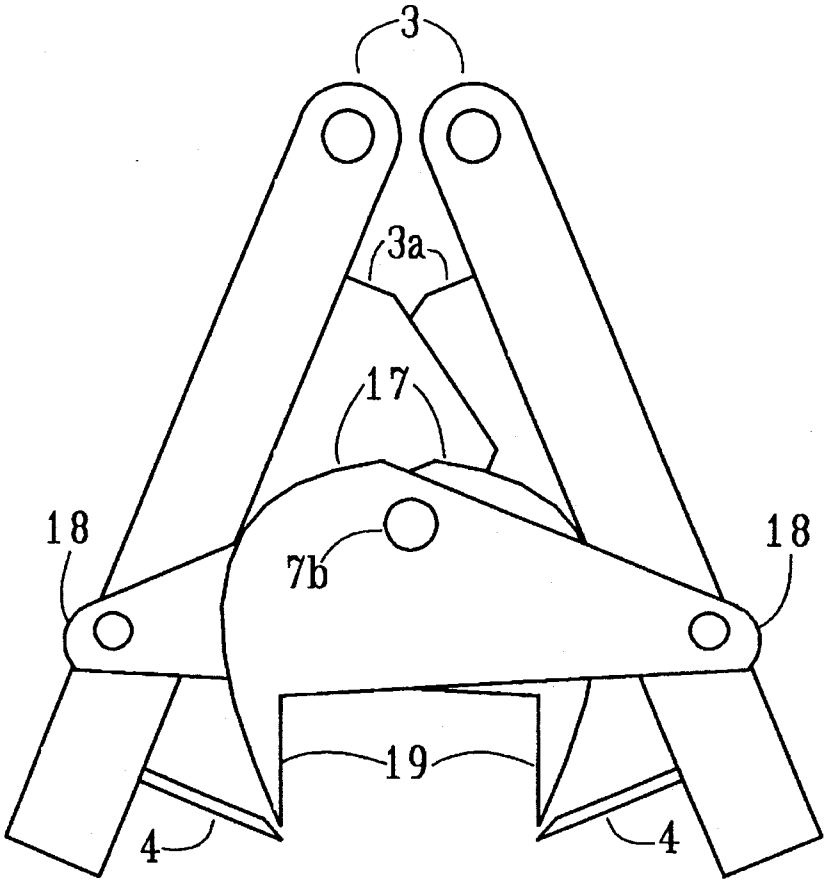
FIGS. 5*a* and 5*b* illustrate means for aiding the ejection of a split-off portion of the workpiece.
Figure 5A:
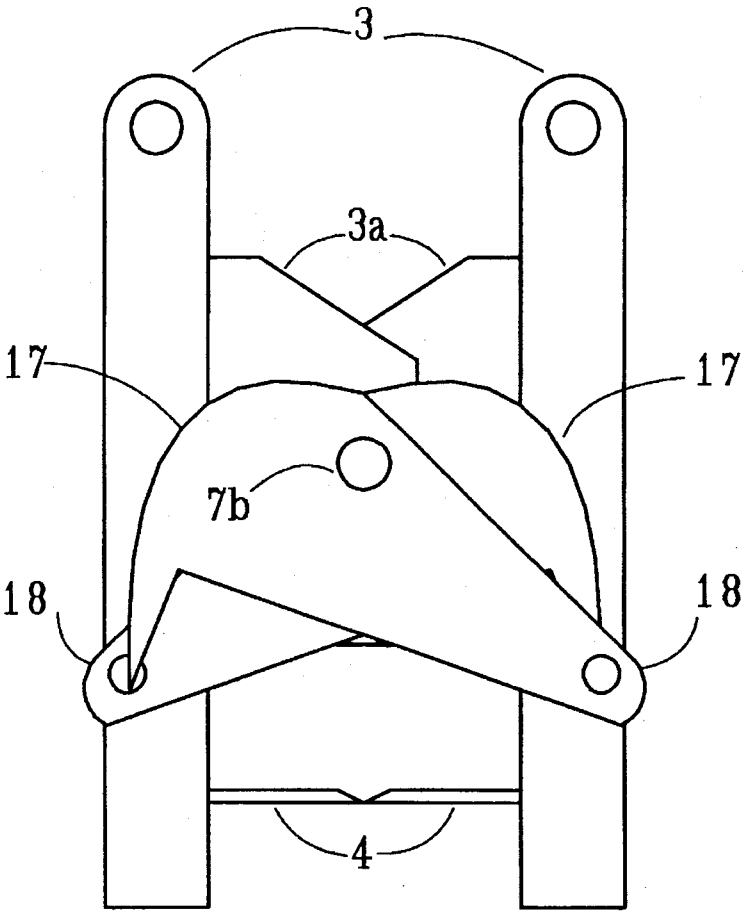

FIGS. 5*a* and 5*b* illustrate an alternative means, used on an alternative embodiment of the invention, of preventing the split-off portion from lodging above the splitter blades. Outboard of jaw subassemblies 3, 3*a* are rakes 17, both pivotably fastened at the aforesaid pivot point 7*b* and each fastened to a different one of jaws 3 at attachment points 18. After the jaws have been closed as shown in FIG. 5*a* to split off a portion of a workpiece (not shown), as they are reopened as shown in FIG. 5*b* rakes 17 pivot so that edges 19 operate to keep the split-off piece centered between splitter blades 4, counteracting any frictional effects which might cause the split-off piece to be drawn to one side by a splitter blade. In this mode, portions of the rakes 17 may act as the aforementioned stop surface.

Description of Operation

Figure 4C:
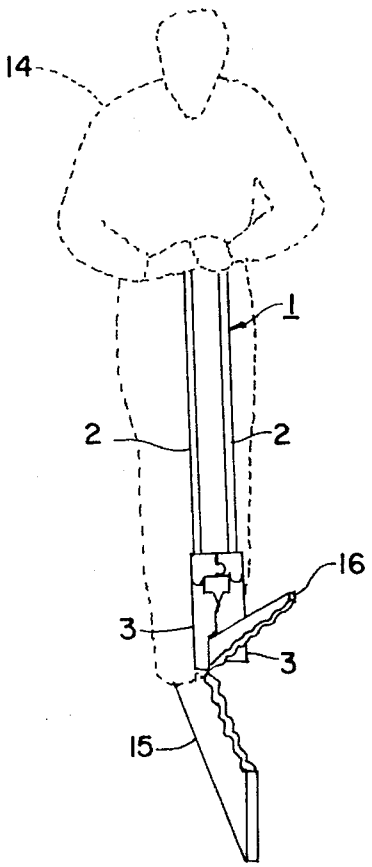
FIG. 4*c* is a schematic illustration of the Board Splitter assembly depicting a user pulling back on the handles of the present invention and causing the section of the piece of scrap lumber, as split from the main piece of scrap lumber and trapped within the jaws 3 of the present invention, to break off—thus demonstrating the third step in preparing a piece of kindling wood.
Figure 4B:
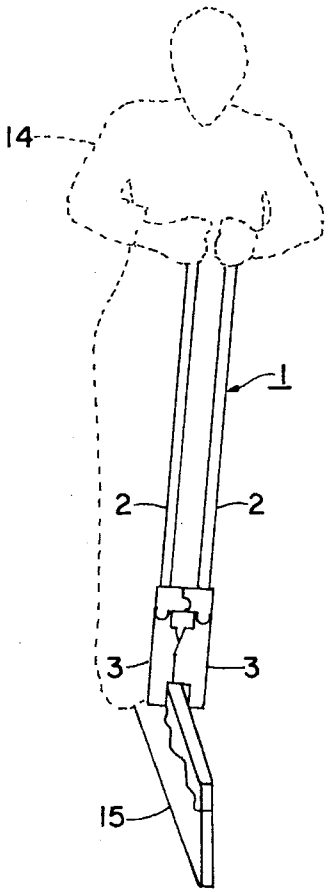
FIG. 4*b* is a schematic illustration of the Board Splitter assembly depicting a user closing the handles of the present invention and causing a split in the piece of scrap lumber, thus demonstrating the second step in preparing a piece of kindling wood.
Figure 4A:
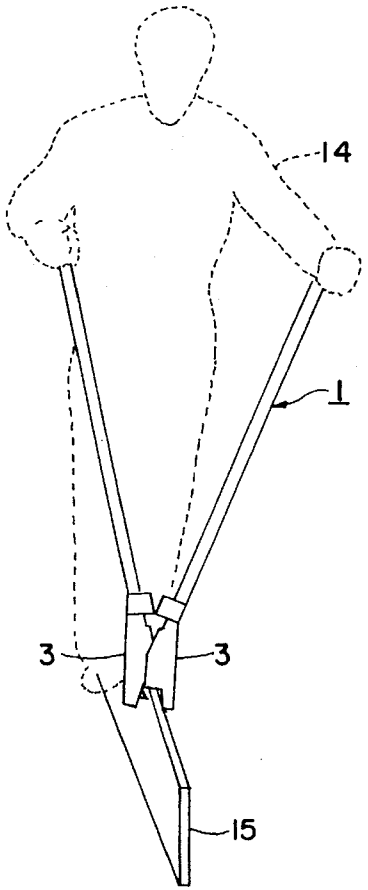
FIG. 4*a* is a schematic illustration of the Board Splitter assembly depicting a user positioning the present invention over a piece of scrap lumber, thus demonstrating the first step in preparing a piece of kindling wood.

FIG. 4*a* depicts a user 14 standing astride a piece of discarded lumber, referred to as the work piece 15, with said piece oriented with its wide dimension in the vertical plane. User 14 is shown holding the present invention, assembly 1, in a vertical position and in its open position. The edge of the work piece 15 is thus engaged between the jaws 3 of assembly 1.

FIG. 4*b* depicts user 14 having completed the first operation which is to close the handle subassemblies 2 thus causing the jaws 3 to plunge the splitter blades 4 (referring to FIG. 1) into work piece 15, which action causes the wood to split along its grain.

FIG. 4*c* depicts user 14 completing the second operation which is to pull back on handle subassemblies 2, thus causing the split section of work piece 15 then trapped within the jaws 3 to break off. This operation creates a piece of kindling wood 1 6 of the size desired by the user. The user 14 may also utilize a forward and backward rocking motion to facilitate the breaking action.

The cycle is completed by opening the handle subassemblies 2 and allowing the kindling wood 16 to drop out.

The invention may be embodied in other specific forms without departing from the spirit thereof. The invention is intended to be embraced by the appended claims and not limited by or to the foregoing embodiments.

I claim:

1. Apparatus for rough-splitting boards or planks comprising:

two elongate handles, each having an outer end for grasping by a user's hand and each having an inner end fastened to a mechanism containing opposing splitting blades, wherein in said mechanism operating the handles in first directions withdraws the splitting blades from each other, permitting insertion of a workpiece between them, and operating the handles in second directions opposite to the first directions impels the splitting blades toward each other, whereby the workpiece is split, the mechanism including centering means for centering said broken-off portion between the splitting blades as they are withdrawn from another, whereby said broken-off piece is not impeded by the splitter blades from dropping out of the apparatus.

2. The apparatus recited in claim 1, wherein further:

the mechanism includes gripping means so disposed that while the handles are operated in the second directions a portion of the workpiece is gripped in the mechanism, whereby operating the handles jointly in third and fourth directions opposite to each other and perpendicular to the first and second directions operates to break said portion of the workpiece off of the workpiece.

3. The apparatus recited in claim 1, wherein said centering means is of flat spring material formed in the shape of a "W" and is disposed so that the workpiece is inserted into the middle of the "W", and the two sides of the "W" are flattened when the apparatus is operated so as to split the workpiece and spring back when the apparatus is operated so as to center said broken-off piece.

4. The apparatus recited in claim 1, wherein said centering means comprise platelike members formed with caliper edges and pivotably mounted to the mechanism in such attitude that the caliper edges retract away from each other when the apparatus is operated so as to split the workpiece and move toward each other when the apparatus is opened, thereby centering said broken-off piece.

5. Apparatus for rough-splitting boards or planks comprising:

two elongate handles, each having an outer end for grasping by a user's hand and each having an inner end fastened to a mechanism containing opposing splitting blades;

the mechanism including a series of compound pivots so arranged that as the handles are operated in first directions the splitting blades move toward each other through a substantially shorter distance than said outer ends of said handles are moved, and that as the handles are moved in second directions opposite to the first directions the splitting blades move away from each other through a substantially smaller distance than said outer ends of said handles are moved;

the mechanism including gripping means so disposed that while the handles are operated in the second directions a portion of the workpiece is gripped by said gripping means whereby a workpiece can be inserted between the, splitting blades when the handles are operated in the second directions and the splitting blades are forced through the workpiece when the handles are operated in the first directions, and whereby operating the handles jointly in third and fourth directions opposite to each other and perpendicular to the first and second directions operates to break said portion of the workpiece off of the workpiece.

6. The apparatus recited in claim 5, wherein further:

the mechanism includes centering means for centering said broken-off portion between the splitting blades as they are withdrawn from another, whereby said broken-off piece is not impeded by the splitter blades from dropping out of the apparatus.

7. The apparatus recited in claim 6, wherein said centering means is of flat spring material formed in the shape of a "W" and is disposed so that the workpiece is inserted into the middle of the "W", and the two sides of the "W" are flattened when the apparatus is operated so as to split the workpiece and spring back when the apparatus is operated so as to center said broken-off piece.

8. The apparatus recited in claim 7, wherein said centering means comprise platelike members formed with caliper edges and pivotably mounted to the mechanism in such attitude that the caliper edges retract away from each other when the apparatus is operated so as to split the workpiece and move toward each other when the apparatus is opened, thereby centering said broken-off piece.

9. Apparatus for rough-splitting boards or planks, comprising:

first and second elongate handles, each having an outer end for grasping by a user's hand and each having an inner end, the inner end of the first handle being fastened to the center portion of a first clevis and the inner end of the second handle being fastened to the center portion of a second clevis, the first and second clevises being pivotably fastened together, the first clevis also being pivotably fastened to a first jaw and the second clevis also being pivotably fastened to a second jaw, the first and second jaws also being pivotably fastened together, platelike first and second splitter blades fastened to the first and second jaws, respectively, so disposed as to substantially meet at least one point along their splitting edges and to be substantially coplanar when the handles are operated in first directions so as to impel the jaws toward each other, the distances between axes of said pivotal fastening being determined so that said splitting edges separate by a predetermined distance when the handles are operated in second directions opposite to the first direction so as to impel the jaws away from each other, whereby operating the handles in the second directions permits insertion of a workpiece no thicker than said predetermined distance between the splitting blades, and operating the handles in the first directions through a distance substantially greater than said predetermined distance operates to split the workpiece.

10. The apparatus recited in claim 9, wherein further:

at least one of said jaws is provided with a stop surface disposed substantially parallel to the splitting blades and between the splitting blades and the point at which said jaws are pivotably fastened together, whereby:

a workpiece may be inserted between the splitting blades only far enough to contact the stop surface, whereby the width of the split portion of the workpiece is predetermined, and after operating the handles in the first directions to split the workpiece the split portion is clamped between the splitting blades and the stop surface, whereby the user may jointly operate the handles in third and fourth directions opposite to each other and perpendicular to the first and second directions so as to break the split portion of the workpiece off of the workpiece.

11. The apparatus recited in claim 9, wherein further:

the mechanism includes centering means for centering said broken-off portion between the splitting blades as they are withdrawn from another, whereby said broken-off piece is not impeded by the splitter blades from dropping out of the apparatus.

12. The apparatus recited in claim 11, wherein said centering means is of flat spring material formed in the shape of a "W" and is disposed so that the workpiece is inserted into the middle of the "W", and the two sides of the "W" are flattened when the apparatus is operated so as to split the workpiece and spring back when the apparatus is operated so as to center said broken-off piece.

13. The apparatus recited in claim 11, wherein said centering means comprise platelike members formed with caliper edges and pivotably mounted to the mechanism in such attitude that the caliper edges retract away from each other when the apparatus is operated so as to split the workpiece and move toward each other when the apparatus is opened, thereby centering said broken-off piece.

* * * * *